US009453321B2

(12) United States Patent
Hartman

(10) Patent No.: US 9,453,321 B2
(45) Date of Patent: Sep. 27, 2016

(54) STAKE DRIVER APPARATUS

(71) Applicant: Michael Hartman, Carson, CA (US)

(72) Inventor: Michael Hartman, Carson, CA (US)

( * ) Notice: Subject to any disclaimer, the term of this patent is extended or adjusted under 35 U.S.C. 154(b) by 78 days.

(21) Appl. No.: 14/458,821

(22) Filed: Aug. 13, 2014

(65) Prior Publication Data

US 2016/0047104 A1 Feb. 18, 2016

(51) Int. Cl.

| | |
|---|---|
| ***E02D 7/04*** | (2006.01) |
| ***B25D 1/16*** | (2006.01) |
| ***E02B 3/04*** | (2006.01) |
| ***E02D 17/20*** | (2006.01) |
| ***E02D 5/80*** | (2006.01) |
| ***B25C 1/00*** | (2006.01) |
| ***E01C 1/00*** | (2006.01) |

(52) U.S. Cl.

CPC . *E02D 7/04* (2013.01); *B25C 1/00* (2013.01); *B25D 1/16* (2013.01); *E01C 1/00* (2013.01); *E02D 5/80* (2013.01); *E02D 17/20* (2013.01)

(58) Field of Classification Search

CPC ..... B25C 1/02; E02D 7/04; E02D 17/20; E02D 5/80; B25D 1/16; E02B 3/04

USPC ..... 405/302.6

See application file for complete search history.

(56) References Cited

U.S. PATENT DOCUMENTS

| | | | | | |
|---|---|---|---|---|---|
| 2,439,524 | A * | 4/1948 | Moore | 111/101 | |
| 2,485,877 | A * | 10/1949 | Hamilton, Jr. | 30/277 | |
| 2,629,985 | A * | 3/1953 | McDowell | B25D 1/16 144/195.5 | |
| 3,838,739 | A * | 10/1974 | Pollard | 172/21 | |
| 4,101,088 | A | 7/1978 | Stauth | | |
| 4,706,864 | A * | 11/1987 | Jacobsen et al. | 227/109 | |
| 4,813,494 | A | 3/1989 | Beard | | |
| 5,542,479 | A | 8/1996 | Stachler | | |
| 6,347,672 | B1 | 2/2002 | Reardon | | |
| 6,571,885 | B2 * | 6/2003 | Lee et al. | 173/1 | |
| 6,796,747 | B1 * | 9/2004 | Vreeland | 405/302.7 | |
| 7,299,962 | B1 * | 11/2007 | Perez | 227/147 | |
| 2005/0039933 | A1 * | 2/2005 | Carter | A01G 17/16 173/1 | |
| 2005/0217188 | A1 * | 10/2005 | Burns | E04H 15/62 52/157 | |
| 2008/0257113 | A1 | 10/2008 | Neumarkel | | |
| 2013/0192652 | A1 * | 8/2013 | Simonson | E02D 5/80 135/118 | |

* cited by examiner

*Primary Examiner* — Tara M. Pinnock

(74) *Attorney, Agent, or Firm* — Steins & Associates, P.C.

(57) ABSTRACT

The apparatus provides the user with the ability to rapidly drive stakes into a straw wattle. There is a slot within the apparatus for inserting a stake and then guiding the stake as the stake is being driven through the wattle and into the ground. A slide hammer shuttle can slide up and down an elongate barrel member to drive a slide hammer into the top of a stake being held within the barrel member. A footrest assembly having adjustable height is incorporated so that the stake and barrel will be spaced above the top surface of the wattle while each stake is being driven into the wattle and ground.

15 Claims, 7 Drawing Sheets

STAKE DRIVER APPARATUS

This application is filed within one year of, and claims priority to Provisional Application Ser. No. 61/865,455, filed Aug. 13, 2013.

BACKGROUND OF THE INVENTION

1. Field of the Invention

This invention relates generally to tools and fixtures and, more specifically, to a Stake Driver Apparatus.

2. Description of Related Art

It is common for local building codes to require the use of a variety of erosion and contamination control systems at construction sites. One such system involves the placement and securing of lengths of straw wattle along open ground in order to prevent dirt erosion from rain and other water incursion. FIG. 1 depicts the common arrangement for the installation of an erosion control wattle.

A berm 10 is formed by placing a length of straw wattle 12 (which is essentially straw bound into long cylindrical lengths) to span an open area, such as along a dirt slope. The wattle 12 will not remain in its position unless or until it is held there by stakes 14. The stakes 14 are conventionally driven through the wattle 12 until they are embedded into the ground, ideally at a spacing of six stakes per twenty-five foot section of wattle 12. Historically, there has been great difficulty driving the stakes 14 through the spongy straw wattle 12. The worker is forced to hold the stake 14 and wattle 12 with one hand, while using the other hand administer the hammer strikes to the stakes 14. In addition to being quite difficult and even dangerous, it is also very time-consuming, particularly if the safer, two-person approach is employed.

A number of prior devices exist for the purpose of driving stakes into the ground. One such device is disclosed by Beard, et al, U.S. Pat. No. 4,813,494 for a "Stake Driver." The Beard Stake Driver enables the user to drive stakes into the ground, but is not well adapted for use with a straw wattle, since use of the device does not allow the user to hold the wattle in place while driving the stakes.

Stachler, et al, U.S. Pat. No. 5,542,479 for a "Hand Operated Impact Tool" describes a stake driver having a cylindrical metal weight for aiding the user in driving stakes. Like Beard, however, Stachler has no provision to assist in holding the straw wattle in place or holding the stake above the wattle when beginning to drive the stake.

Reardon, U.S. Pat. No. 6,347,672 discloses a stake driver attachment for "use with a handheld jackhammer." The Reardon device allows for power-assisted driving of the stakes, but does not assist in the positioning of the stakes, or holding of the wattle in place.

J. S. T. McDowell, U.S. Pat. No. 2,629,985 is similar to Stachler, but also fails to aid in positioning the stake and/or wattle. Stauth, U.S. Pat. No. 4,101,088 employs a sliding sleeve/weight, but also fails to assist the user in holding the stake or wattle. Finally, Neumarkel, U.S. Patent Application Publication No. US2008/0257113 discloses a slide-hammer-type design that requires both of the user's hands, but does not aid in the holding of the wattle.

What is needed is a stake driving apparatus that is particularly well suited for the difficult job of securing a straw wattle (or other thick items) to the ground using stakes.

SUMMARY OF THE INVENTION

In light of the aforementioned problems associated with the prior devices, it is an object of the present invention to provide a Stake Driver Apparatus. The apparatus should provide a user with the ability to rapidly drive stakes into a straw wattle. There should be a slot within the apparatus for inserting a stake and then guiding the stake as the stake is being driven through the wattle and into the ground. A slide hammer shuttle should slide up and down an elongate barrel member to drive a slide hammer into the top of a stake being held within the barrel member. A footrest assembly should be included so that the stake and barrel will be spaced above the top surface of the wattle while each stake is being driven into the wattle and ground.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Stake Driver Apparatus.

Figure 1:
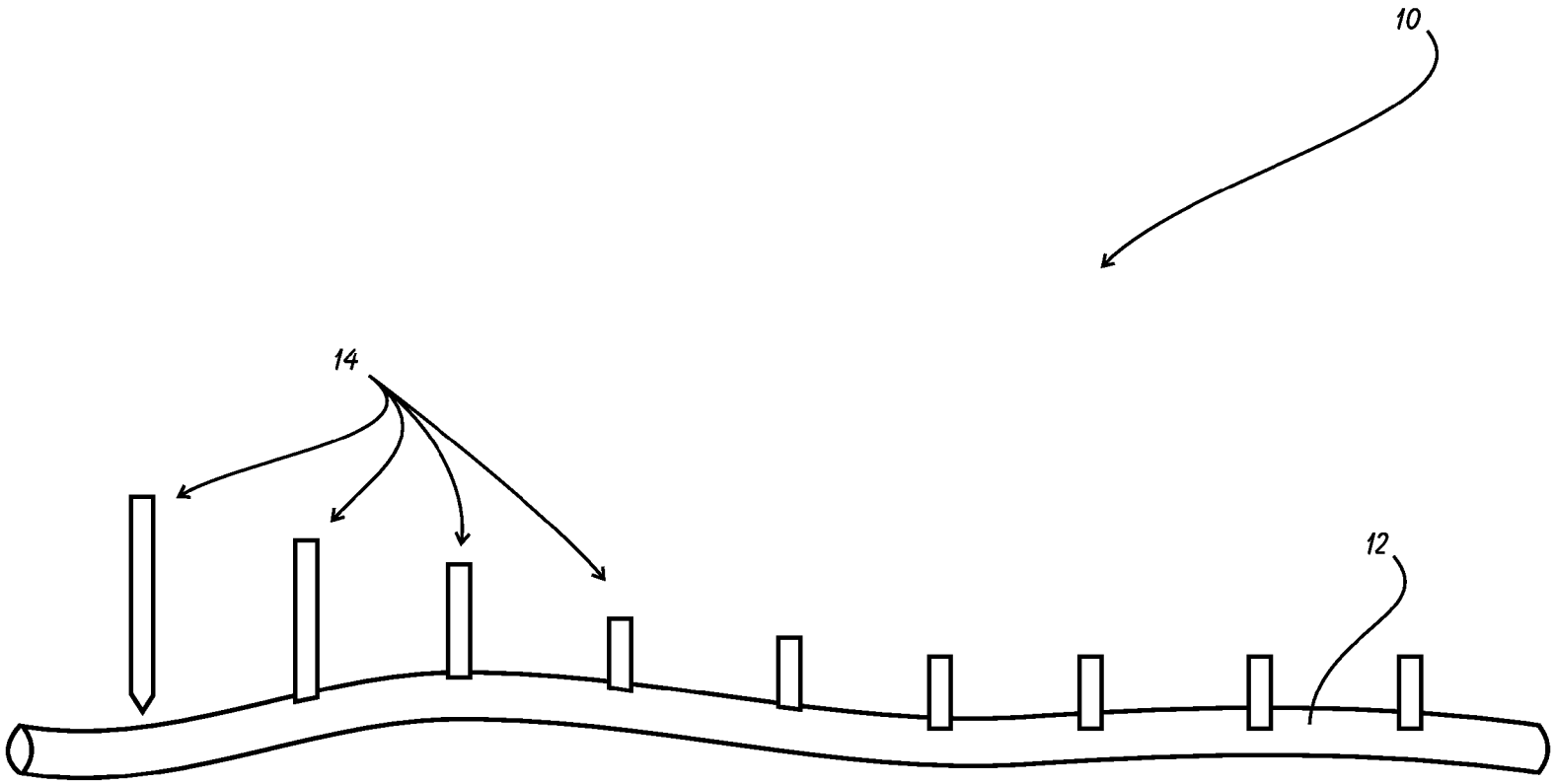
FIGURE 1 PRIOR ART
FIG. 1 depicts a conventional berm formed from a straw wattle.
Figure 2:
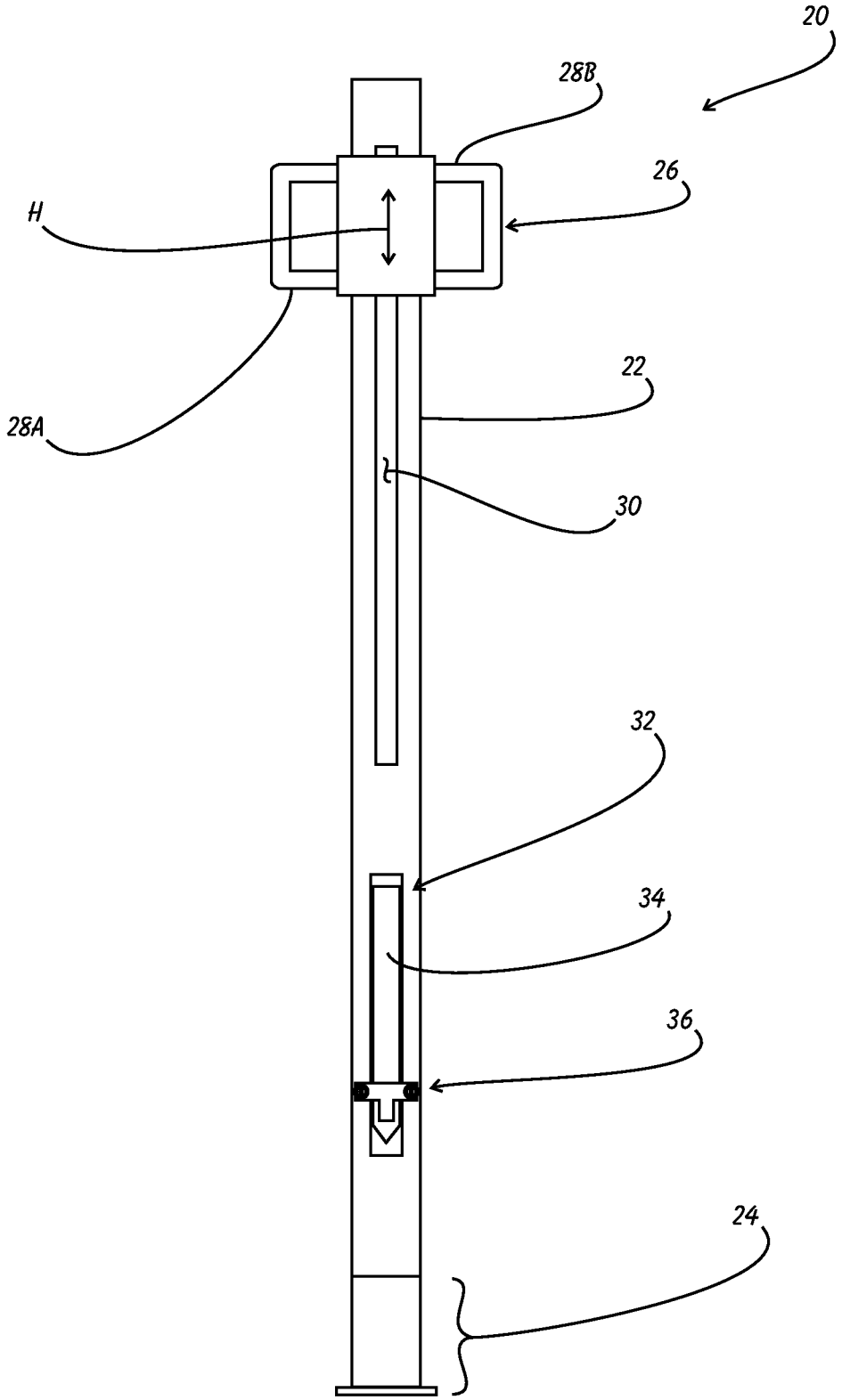
FIG. 2 is a front view of a preferred embodiment of the stake driving apparatus of the present invention.

The present invention can best be understood by initial consideration of FIG. 2.[1] FIG. 2 is a front view of a preferred embodiment of the stake driving apparatus 20 of the present invention. The driver 20 is composed of a main barrel member 22 that is an elongate rectangular tube that terminates in a footrest assembly 24 at its bottom end. The barrel member 22 is sized just slightly larger than a standard grade stake. A slide hammer shuttle 26 is permitted to slide over the upper portion of the barrel member 22 in direction "H" along hammer guide slot 30 (which is typically a pair of matching slots formed in the front and rear walls of the barrel member 22). The slide hammer shuttle 26 preferably has a pair of outer handles 28A, 28B which the user can grasp.

[1]As used throughout this disclosure, element numbers enclosed in square brackets [ ] indicates that the referenced element is not shown in the instant drawing figure, but rather is displayed elsewhere in another drawing figure.

A stake slot 32 is formed through the lower front wall of the barrel member 22. The stake slot 32 is formed to be just large enough to accept a conventional (14 inch long) wooden stake 34—this is the typical size of stake used for securing wattle. The stake guide 36 is a spring-loaded retainer that will hold a stake 34 in place within the barrel member 22 while the user prepares to begin driving the stake 34 through the wattle. Additional detail is provided below in connection with FIGS. 5A-5C. If we now turn to FIG. 3, we can see other features of this novel and nonobvious device.

Figure 3:
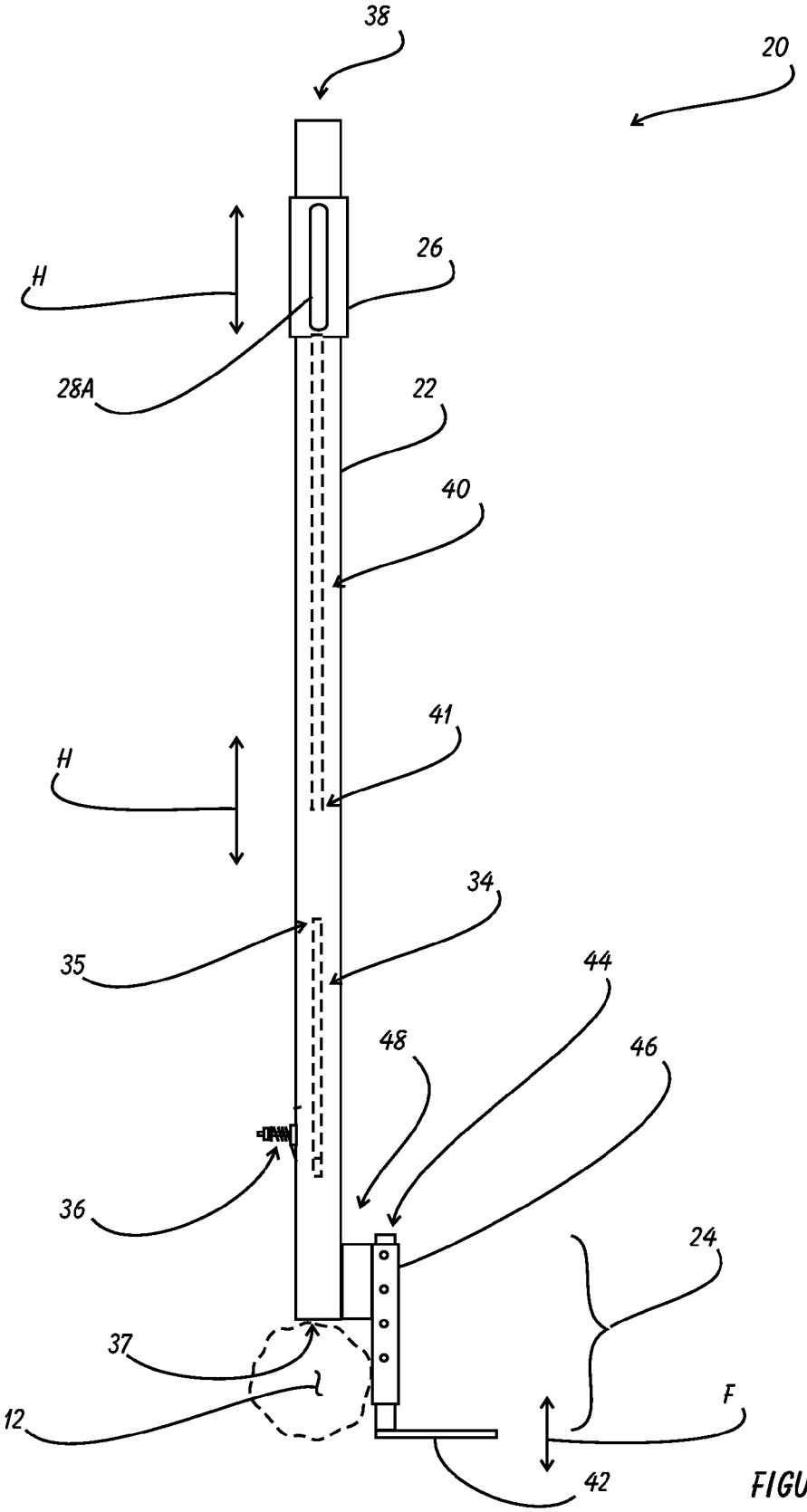
FIG. 3 is a side view of the apparatus of FIG. 2.

FIG. 3 is a side view of the apparatus 20 of FIG. 2. The barrel member 22 is generally hollow, forming an interior guide bore 38 along its length. The slide hammer shuttle 26 is attached to a slide hammer rod 40 (through the front and rear hammer guide slots [30]). Since these elements are interconnected, when the shuttle 26 is slid up and down in direction "H," the slide hammer rod 40 will move in the same "H" motion.

When a stake 34 is inserted through the stake slot [32] and into the guide bore 38, it will be held in place within the bore 38 by the stake guide 36. As should be apparent from the geometry, the slide hammer 26 can be slid down so that the tip 41 of the rod 40 can strike the head 35 of the stake 34 that is being held in the guide bore 38 by the stake guide 36. As the hammer 26 is slid to drive the tip 41 into the head 35, the stake 34 will be driven downward through the bottom opening 37 formed in the barrel member 22.

The footrest assembly 24 is attached to the barrel member 22 at its bottom end by linkage 48 extending from the barrel member 22. Outer bracket 46 is a sleeve extending down from the linkage 48 (parallel to the barrel member 22), and preferably having a plurality of holes formed along its length (to accomodate an inserted pin therethrough). Inner strut 44 slides through the sleeve formed by the outer bracket 46. Foot element 42 is a generally flat piece of metal attached to the bottom end of the inner strut 44. The purpose of the footrest assembly 24 is to pre-position the bottom opening 37 of the stake driver 20 over the top of the straw wattle 12 before commencing stake driving. The extension of the foot element 42 from the barrel member 22 (distance "F") is adjusted until the desired height is reached, and then the inner strut 44 is fixed in its sliding travel along the outer bracket 46 (such as with the aforementioned pin).

Figure 4B:
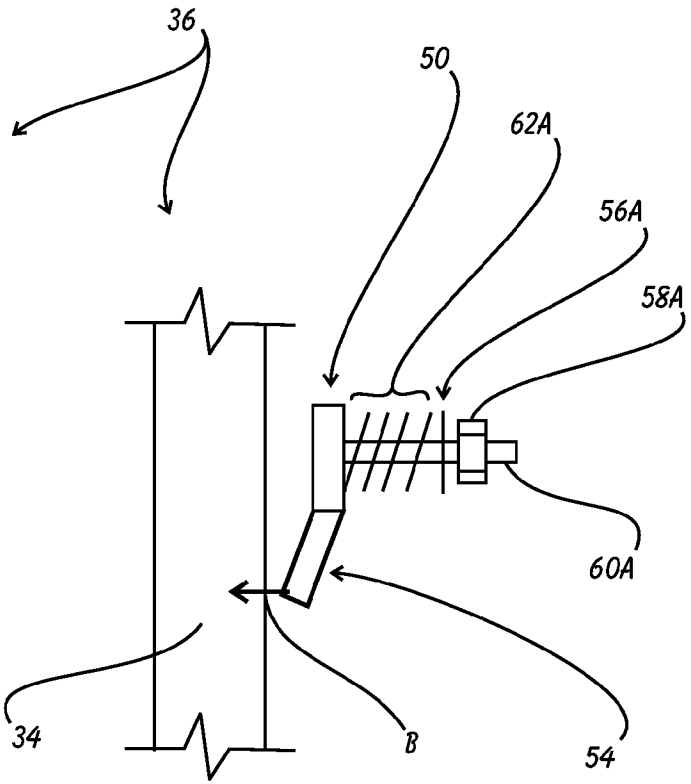
FIGS. 4A and 4B are partial front and side views, respectively, of the stake guide assembly.
Figure 4A:
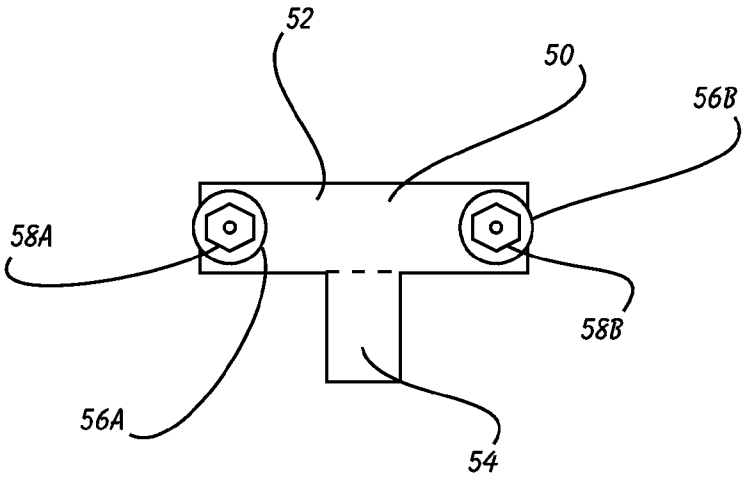

It should be apparent from this view and description that the device of the present invention greatly assists the user in driving stakes into sections of straw wattle. Once a stake 34 is loaded into the driver 20, the user will not need to grasp it again. The user simply has to set the foot element 42 next to the wattle 12 to be staked, so that the bottom opening is directly over the wattle 12. The user then only uses the mechanical advantage of the slide hammer shuttle 26 to drive the tip 41 of the rod 40 into the head 35 of the stake 34 repeatedly until the stake 34 has been driven into the ground to the desired depth. FIGS. 4A and 4B provide additional detail regarding the manner in which stakes are held within the barrel member 22.

FIGS. 4A and 4B are partial front and side views, respectively, of the stake guide assembly 36. From the front (FIG. 4A), the biasing plate 50 can be seen to be a generally "T" shape, with a cross-plate portion 52 and a central finger portion 54 extending downwardly therefrom. At each end of the cross-plate portion 52, retaining nuts 58A, 58B and washers 56A, 56B hold the plate 50 to the barrel member [22].

Figures 5A, 5B, 5C:
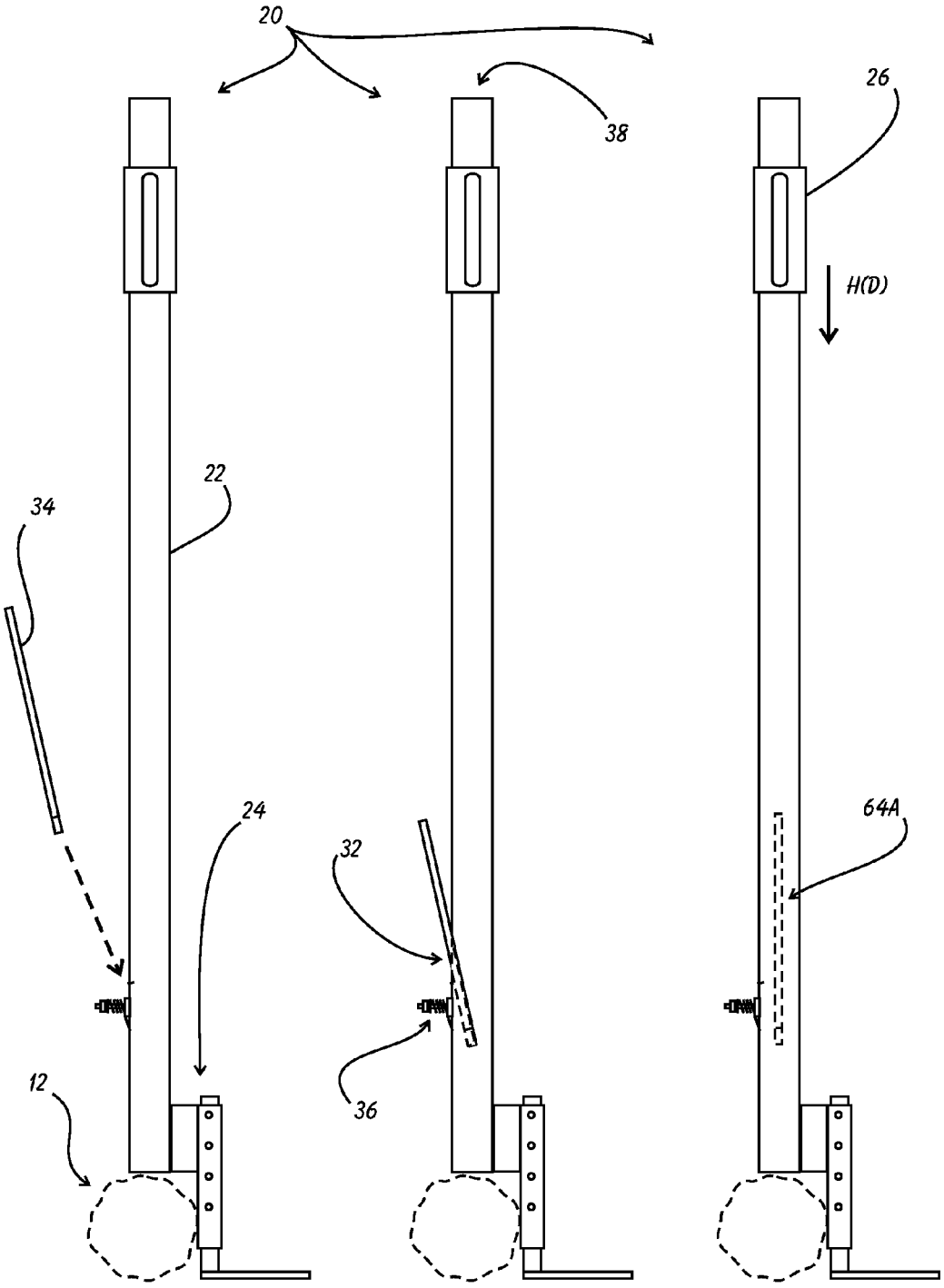
FIGS. 5A, 5B and 5C are side views of the device of FIGS. 2 and 3 to show the sequence of the stake loading process.

In FIG. 4B, the stake 34 can be seen as it would be positioned within the guide bore [38]. The retaining shafts (60A shown here) extend from the barrel member [22] on either side of the stake slot [32]. The retaining nuts and washers (58A and 56A shown here) compress springs (62A shown here) between the washers and the biasing plate 50 so that the biasing plate 50 is pushed towards the stake 34 in direction "B." The finger portion 54 protrudes through the stake slot [32] so that it can press against the front of the stake 34 in the guide bore [38]. Since the finger portion 54 is angled downwardly, it will allow the stake 34 to slide down as the stake 34 is being driven by the slide hammer rod [40]. It also allows the user to easily insert a fresh stake 34 into the stake slot [32] and behind the stake guide 36 from above. FIGS. 5A-5C depict the stake loading sequence.

Figure 6C:
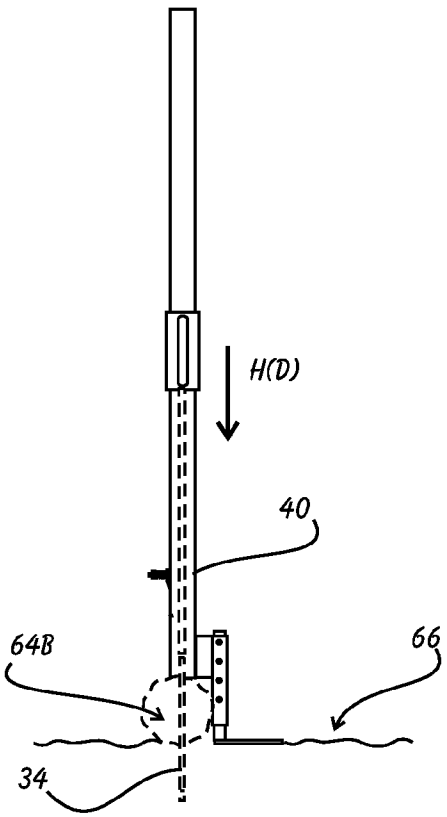
FIGS. 6A, 6B and 6C are side views of the device of FIGS. 2 and 3 to show the sequence of the stake driving process.
Figure 6B:
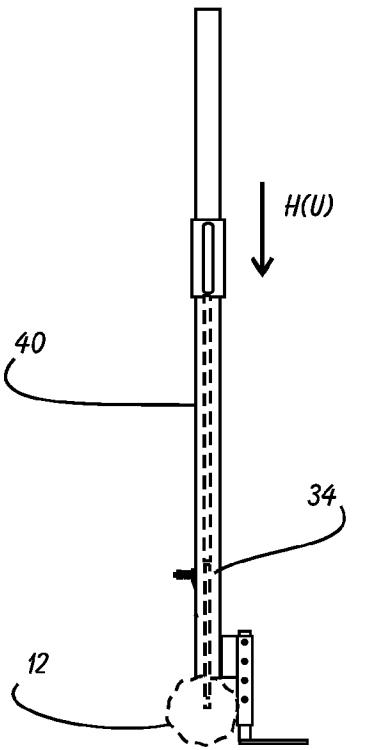
Figure 6A:
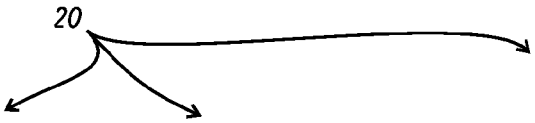
Figure 6A:
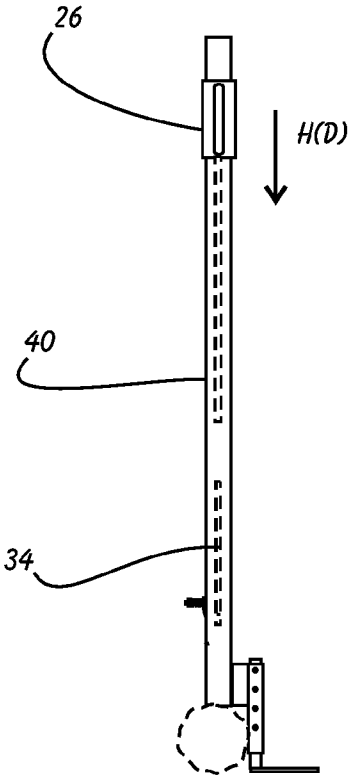

First, the footrest assembly 24 is positioned so that it provides the proper height to clear the wattle 12. It is adjustable so that different diameters of wattle can be accommodated (e.g. both 6-inch diameter and 8-inch diameter wattle). The adjustment can also be used to choose the depth that the stakes are going to be driven into the ground/wattle. To begin the stake loading process, the driver 20 will be positioned as shown over the straw wattle 12. A stake 34 is then inserted into the stake slot 32 above the stake guide 36 (at an angle relative to the barrel member 22. As the stake 34 is inserted into the guide bore 38 via the stake slot 32, it is being pushed towards the back of the guide bore 38 by the stake guide 36. Ultimately, the stake 34 will have been fully inserted into the guide bore 38 until it is in the ready position 64A, and being held in place by the stake guide 36. In the ready position 64A, the stake 34 is ready for the user to begin hammering it into the wattle 12 and ground by repeatedly sliding the slide hammer shuttle 26 in direction $H_D$ and then back up to the top of the barrel member 22. FIGS. 6A-6C depict the steps in the stake driving process.

In FIG. 6A, the stake 34 is in the ready position [64A]. As the shuttle 26 is moved down in direction $H_D$, the slide hammer rod 40 will eventually strike the top of the stake 34 and drive it to be partially embedded in the wattle 12. The shuttle 26 is then lifted in direction $H_U$ by the user until it is at or near the apex of the hammer guide slot [30]. The shuttle 26 is then driven downward again. This sequence is repeated over and over until the rod 40 has driven the stake 34 to its final position 64B (depicted in FIG. 6C) where the stake 34 is penetrating through the wattle 12 and into the ground 66. The stake driver 20 can then be lifted off of the head [35] of the stake 34, and moved to the next future stake location, which is depicted in FIG. 5A. Using this device 20, the stakes 34 can rapidly be driven along the length of the wattle 12, to the same depth (ideally with the stake head protruding to inches above the height of the wattle).

Figure 7:
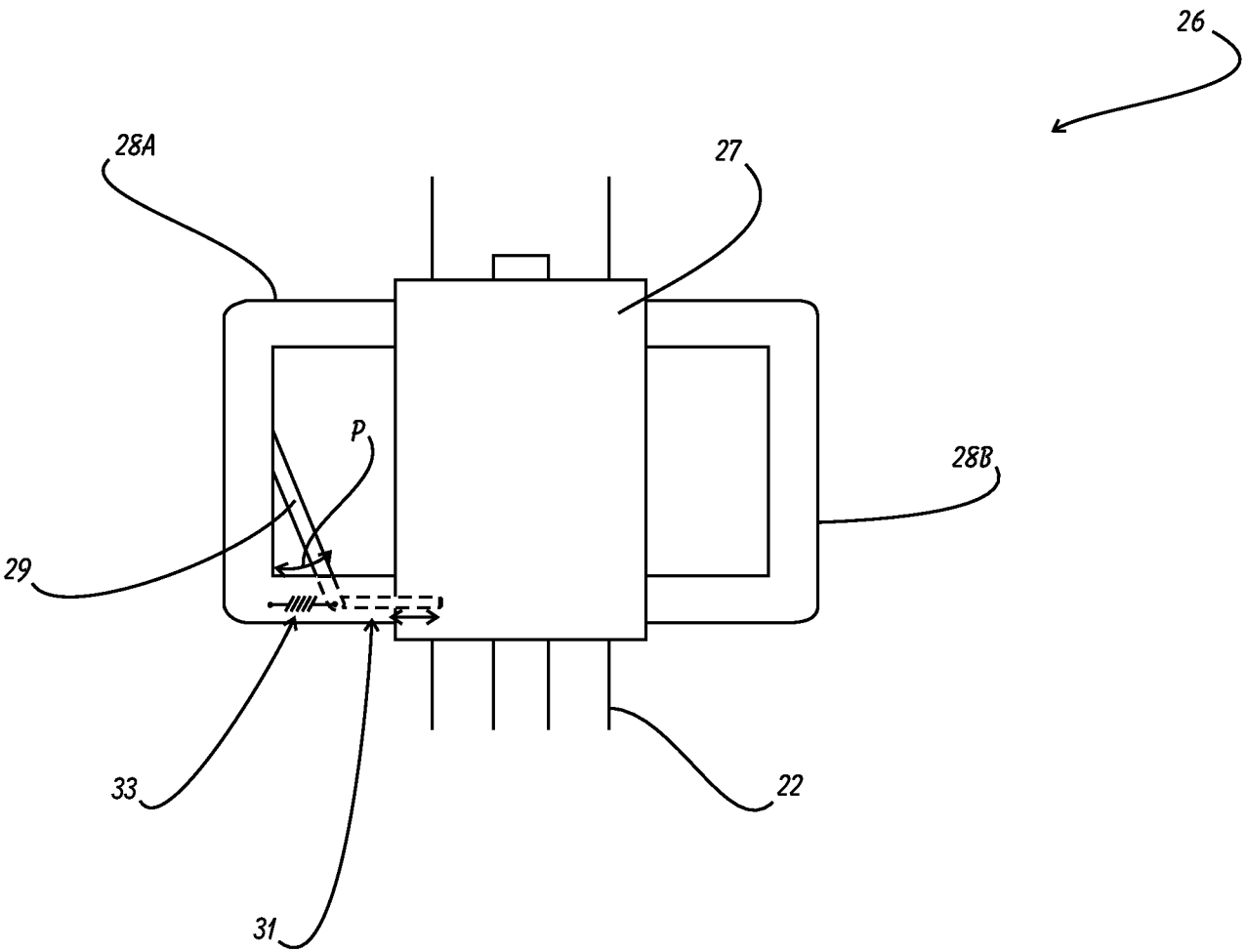
FIG. 7 is a partial cutaway front view of the slide hammer shuttle area of the apparatus of FIG. 2.

A final feature of the instant device is depicted in FIG. 7. FIG. 7 is a partial cutaway front view of the apparatus of FIG. 2. A locking mechanism has been incorporated into the slide hammer shuttle 26 for the purpose of securing the slide hammer shuttle 26 in the raised position. In the raised position, the slide hammer rod [40] is positioned to allow a stake [34] to be inserted into the stake slot [32]. The raised position is also the desired position for transporting the apparatus (i.e. it is in the "safe" position).

The slide hammer sleeve 27 has one or more handles 28A, 28B extending outwardly from it. A locking mechanism is incorporated into the sleeve 27 to lock the sleeve 27 in place along the barrel member 22. In this embodiment, the locking mechanism is made up of a trigger element 29 that pivots in the direction of arrow "P." A locking pin 31 is pivotally attached to the end of the trigger element 29. When extended, the locking pin 31 will engage an aperture formed in the barrel member 22 (thereby locking the slide hammer sleeve 27 in place). A biasing element 33 urges the locking pin 31 towards the locked position. Pulling back on the trigger element 29 will release the locked sleeve 27.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A hand-operated device for driving elongate items through an object and into through the surface upon which the object is resting, comprising:

an elongate barrel member having a longitudinal bore formed substantially along its length, said barrel member terminating at a bottom end, said bore terminating in a bottom opening at said bottom end;

a footrest assembly extending downwardly from said barrel member and terminating in a foot element, said foot element in spaced relation to and extending beyond said bottom end;

a slide hammer shuttle external to, and slidingly engaging said barrel member; and a slide hammer rod located within said bore and extending downwardly from said slide hammer.

2. The device of claim 1, wherein said barrel member is further defined by a longitudinal slot formed through said barrel member and into said bore, said slot located between said slide hammer rod and said bottom end.

3. The device of claim 2, further comprising a biasing element attached to said barrel member and extending through said longitudinal slot and protruding into said bore.

4. The device of claim 3, wherein said footrest assembly further comprises a strut slidingly engaging said barrel member, said foot element extending from said strut, whereby the distance that said foot element extends from said bottom end is slidingly adjustable by slidingly adjusting said strut.

5. The device of claim 4, wherein said slide hammer shuttle comprises a sleeve encircling a portion of said barrel member and one or more handles extending from said sleeve.

6. The device of claim 5, further comprising a locking mechanism for restraining said sleeve from sliding along said barrel member.

7. A method for securing a straw wattle to the soil, comprising the steps of:

laying a segment of wattle on the soil in the location where it is to be secured;

obtaining a stake driver device, said stake driver device comprising:

an elongate barrel member defining in internal guide bore along its length opening at its bottom in a bottom opening;

a footrest assembly extending downwardly from said barrel member, said footrest assembly comprising a foot element in spaced relation to said bottom opening at a distance F, said footrest assembly configured to allow said distance F to be adjustable; and a slide hammer shuttle and a slide hammer rod extending therefrom, said slide hammer rod located within said guide bore;

inserting a stake element into said guide bore between said slide hammer rod and said bottom opening;

adjusting said footrest assembly such that said distance F will generally equal a diameter defined by said wattle segment;

positioning said stake driver device with said foot element on the soil adjacent to said wattle segment whereby said bottom opening is juxtaposed over said wattle segment;

sliding oscillating said slide hammer shuttle up and down along said elongate barrel to repeatedly strike a top end of said stake to drive said stake through said wattle segment and into said soil.

8. The method of claim 7, wherein:

said stake driver device of said obtaining step further comprises a longitudinally-oriented stake slot formed in a wall defining said barrel member; and wherein said inserting step comprises inserting a stake through said stake slot and into said guide bore.

9. The method of claim 8, wherein:

said stake driver device of said obtaining step further comprises a stake guide attached to said barrel member adjacent to one end of said stake slot; and wherein said inserting step comprises inserting a stake through said stake slot such that said stake guide is in contact with said stake when it is inserted into said guide bore.

10. An apparatus for driving elongate items into soil, comprising:

an elongate barrel member having a bore formed substantially along its length aligned with a longitudinal axis defined by said barrel, said barrel member terminating at a bottom end, said bore terminating in a bottom opening at said bottom end;

a footrest assembly extending downwardly from said barrel member and terminating in a foot element, said foot element in spaced relation to said bottom end in a direction parallel to said longitudinal axis so as to extend beyond said bottom end;

a slide hammer shuttle encircling the outer surface of, and slidingly engaging said barrel member; and a slide hammer rod located within said bore and extending downwardly from said slide hammer.

11. The apparatus of claim 10, wherein said barrel member is further defined by a longitudinal slot formed through said barrel member and opening into said bore, said slot located between said slide hammer rod and said bottom end.

12. The apparatus of claim 11, further comprising a biasing element attached to said barrel member and extending through said longitudinal slot and protruding into said bore.

13. The apparatus of claim 12, wherein said footrest assembly further comprises a strut slidingly engaging said barrel member, said foot element extending from said strut, whereby the distance that said foot element extends from said bottom end is slidingly adjustable by slidingly adjusting said strut along said longitudinal axis.

14. The apparatus of claim 13, wherein said slide hammer shuttle comprises a sleeve encircling a portion of said barrel member and one or more handles extending from said sleeve.

15. The apparatus of claim 14, further comprising a locking mechanism for restraining said sleeve from sliding along said barrel member.

* * * * *